US011585286B2

(12) United States Patent
Yamada et al.

(10) Patent No.: US 11,585,286 B2
(45) Date of Patent: Feb. 21, 2023

(54) DATA PROCESSING METHOD

(71) Applicants: TOYOTA JIDOSHA KABUSHIKI KAISHA, Toyota (JP); DENSO CORPORATION, Kariya (JP)

(72) Inventors: Takafumi Yamada, Okazaki (JP); Hiroyuki Akuzawa, Kariya (JP); Noboru Kitahara, Kariya (JP); Takashi Ooga, Kariya (JP); Taichi Watanabe, Kariya (JP)

(73) Assignees: TOYOTA JIDOSHA KABUSHIKI KAISHA, Toyota (JP); DENSO CORPORATION, Kariya (JP)

( * ) Notice: Subject to any disclaimer, the term of this patent is extended or adjusted under 35 U.S.C. 154(b) by 0 days.

(21) Appl. No.: 17/655,667

(22) Filed: Mar. 21, 2022

(65) Prior Publication Data

US 2022/0333547 A1 Oct. 20, 2022

(30) Foreign Application Priority Data

Apr. 16, 2021 (JP) ..... JP2021-069518

(51) Int. Cl.
*F02D 41/00* (2006.01)
*F02D 41/24* (2006.01)
*F02D 41/28* (2006.01)

(52) U.S. Cl.
CPC ..... *F02D 41/2409* (2013.01); *F02D 41/0002* (2013.01); *F02D 2041/288* (2013.01); *F02D 2200/04* (2013.01); *F02D 2250/12* (2013.01); *F02D 2250/14* (2013.01)

(58) Field of Classification Search
CPC ..... F02D 41/0002; F02D 41/2409; F02D 2041/286; F02D 2041/288; F02D 2200/04; F02D 2250/12; F02D 2250/14
See application file for complete search history.

(56) References Cited

U.S. PATENT DOCUMENTS 6,138,504 A * 10/2000 Lewis ..... F02D 41/32 73/114.37
8,977,470 B2 * 3/2015 Leone ..... F02D 41/008 123/336
10,934,960 B2 * 3/2021 Wu ..... F02D 41/18
2006/0042593 A1 * 3/2006 Nakamoto ..... F02D 41/26 123/336

(Continued)

FOREIGN PATENT DOCUMENTS

JP 2018-159369 A 10/2018

OTHER PUBLICATIONS

U.S. Appl. No. 17/579,961, filed Jan. 20, 2022, Yamada et al.

*Primary Examiner* — Erick R Solis
(74) *Attorney, Agent, or Firm* — Oblon, McClelland, Maier & Neustadt, L.L.P.

(57) ABSTRACT

A data processing method of variable measurement data in an electronic control unit (ECU) is provided. The ECU that processes the data processing method calculates a filtering frequency based on a delay time frequency based on a transmission timing cycle of the measurement data and a processing timing cycle of the measurement data in the ECU, and also based on a pulsation frequency of the measurement data, and removes, from the measurement data, a component of the filtering frequency calculated in the calculation of the filtering frequency.

5 Claims, 6 Drawing Sheets

(56) References Cited

U.S. PATENT DOCUMENTS

| | | | | |
|---|---|---|---|---|
| 2009/0012693 | A1* | 1/2009 | Kalweit | F02D 41/18 701/102 |
| 2012/0020384 | A1* | 1/2012 | Mikami | F02D 41/3836 374/144 |
| 2014/0278012 | A1* | 9/2014 | Xiao | F02D 41/18 701/108 |
| 2020/0141346 | A1* | 5/2020 | Wu | F02D 41/18 |
| 2020/0264023 | A1* | 8/2020 | Kitahara | G01F 1/72 |
| 2021/0317796 | A1* | 10/2021 | Schmidt | G01M 15/046 |

* cited by examiner 2000 rpm 2200 rpm 2400 rpm 2600 rpm 2800 rpm

DATA PROCESSING METHOD

CROSS-REFERENCE TO RELATED APPLICATION

This application claims priority to Japanese Patent Application No. 2021-069518 filed on Apr. 16, 2021, incorporated herein by reference in its entirety.

BACKGROUND

1. Technical Field

The present disclosure relates to a data processing method.

2. Description of Related Art

Japanese Unexamined Patent Application Publication No. 2018-159369 (JP 2018-159369 A) discloses a technique in which an electronic control unit (ECU) mounted on a vehicle acquires measurement data of an intake air amount measured by an airflow sensor by single edge nibble transmission (SENT) communication, and executes arithmetic processing related to control of an injection amount of a fuel injection valve based on the acquired measurement data.

SUMMARY

However, the inventors of the present disclosure have found a possibility that, when the related art is used, an error arises in the measurement data acquired by the ECU due to a periodic change in a difference between a timing of the SENT communication and a timing of ECU processing (delay time) and a periodic intake pulsation by the operation of an internal combustion engine, and an undulation phenomenon arises at a specific rotation speed in processing result data of an averaging process.

The present disclosure provides a data processing method that suppresses occurrence of an undulation phenomenon in numerical values by arithmetic processing based on variable measurement data.

An aspect of the present disclosure relates to a data processing method of variable measurement data in an electronic control unit. The data processing method includes: (i) performing a calculation of a filtering frequency based on a delay time frequency based on a transmission timing cycle of the measurement data and a processing timing cycle of the measurement data in the electronic control unit, and also based on a pulsation frequency of the measurement data; and (ii) removing, from the measurement data, a component of the filtering frequency calculated in the calculation of the filtering frequency.

In the data processing method of the above aspect, the measurement data may be data indicating an operating state of a vehicle.

In the data processing method of the above aspect, the measurement data may be data indicating an operating state of an internal combustion engine of a vehicle.

In the data processing method of the above aspect, the measurement data may be data indicating an intake air amount of the internal combustion engine.

According to the data processing method of the above aspect, it is possible to suppress occurrence of an undulation phenomenon in the numerical value by arithmetic processing based on variable measurement data.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Hereinafter, a data processing method according to an embodiment as an example of the present disclosure will be described with reference to the drawings.

First, a configuration of a data processing system 10 will be described.

Figure 1:
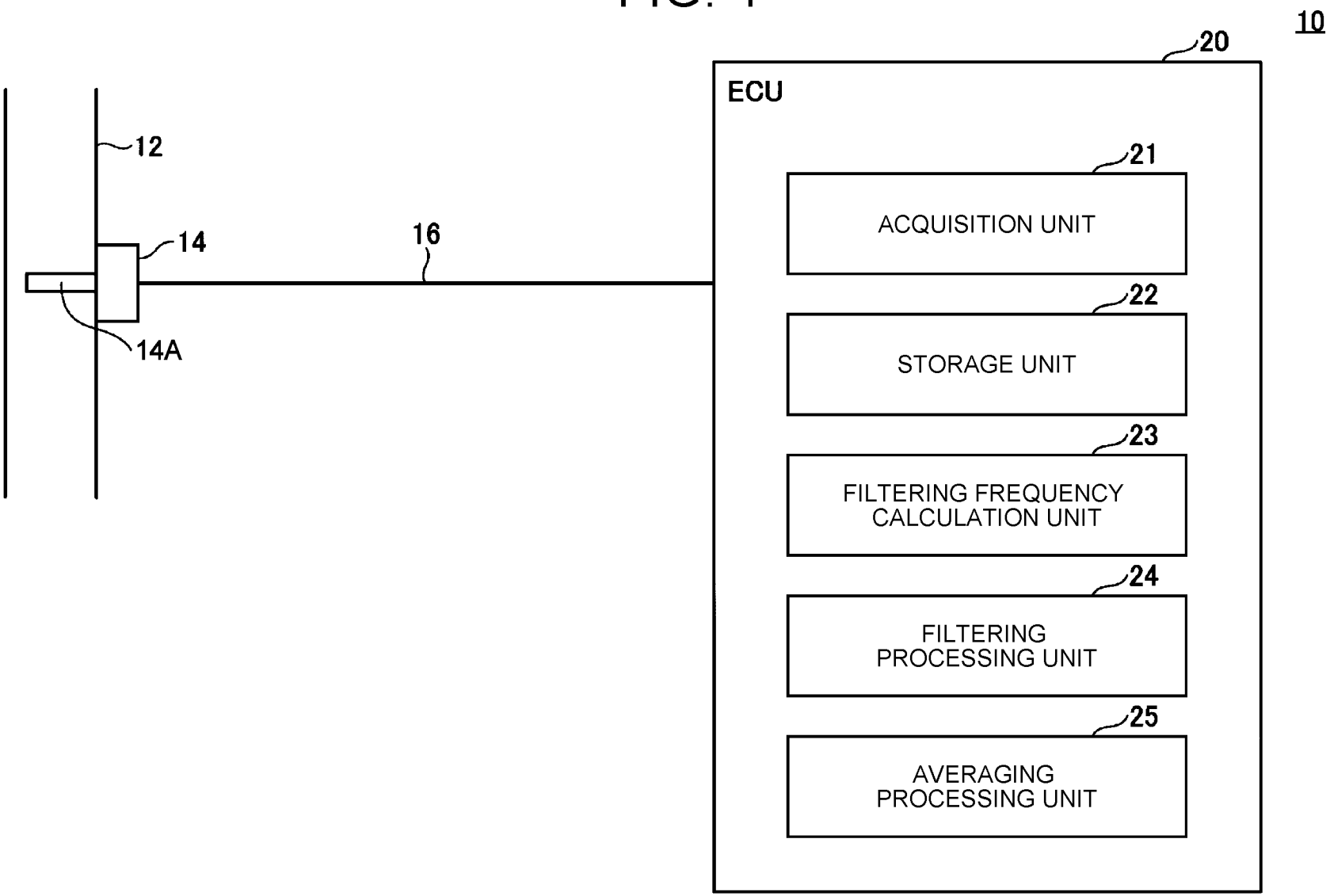
FIG. 1 is a diagram showing a configuration of a data processing system according to an embodiment as an example of the present disclosure.

FIG. 1 is a diagram showing the configuration of the data processing system 10 according to the embodiment. The data processing system 10 shown in FIG. 1 is a system mounted on a vehicle equipped with an internal combustion engine, such as an automobile.

As shown in FIG. 1, the data processing system 10 includes an airflow sensor 14 and an electronic control unit (ECU) 20.

The airflow sensor 14 is provided at a predetermined position (for example, between an air cleaner and a throttle valve) in an intake passage 12 of the internal combustion engine. The airflow sensor 14 detects an amount of intake air (intake air amount) flowing through the intake passage 12. The airflow sensor 14 includes a heat generating resistor 14A disposed in the intake passage 12. The airflow sensor 14 can detect the intake air amount as a resistance value of the heat generating resistor 14A changes in accordance with the intake air amount.

The airflow sensor 14 is communicatively connected to the ECU 20 by a communication path 16. With this configuration, the airflow sensor 14 can transmit measurement data of the intake air amount detected by the airflow sensor 14 to the ECU 20 by the SENT communication via the communication path 16. The airflow sensor 14 transmits the measurement data of the intake air amount to the ECU 20 at predetermined cycles (for example, 0.846 milliseconds (ms)).

The airflow sensor 14 is an example of a sensor, and as an example, the measurement data is transmitted to the ECU 20 as a digital signal by the SENT communication. Examples of the measurement data related to the intake air amount include, but are not limited to, a voltage value corresponding to the intake air amount. A pressure sensor may be used instead of the airflow sensor 14. In this case, the ECU 20 calculates a pressure value transmitted from the pressure sensor.

The ECU 20 is an example of a "data processing device" and processes the measurement data of the intake air amount supplied from the airflow sensor 14. As shown in FIG. 1, the ECU 20 includes an acquisition unit 21, a storage unit 22, a filtering frequency calculation unit 23, a filtering processing unit 24, and an averaging processing unit 25.

Next, the acquisition unit 21 will be described. The acquisition unit 21 acquires the measurement data of the intake air amount transmitted from the airflow sensor 14 via the communication with the airflow sensor 14 (data acquisition step). Further, the acquisition unit 21 stores the acquired measurement data of the intake air amount in the storage unit 22 (data storage step). The acquisition unit 21 acquires the measurement data of the intake air amount each time the measurement data of the intake air amount is transmitted from the airflow sensor 14 at predetermined cycles, and stores the acquired measurement data of the intake air amount in the storage unit 22. Therefore, the storage unit 22 stores the measurement data of a plurality of the intake air amounts continuously measured by the airflow sensor 14.

Next, the filtering frequency calculation unit 23 will be described. The filtering frequency calculation unit 23 calculates a filtering frequency based on a delay time frequency based on a transmission timing cycle of the measurement data by the airflow sensor 14 and a processing timing cycle of the measurement data in the ECU 20, and a pulsation frequency of the intake pulsation (filtering frequency calculation process). The "delay time frequency" is a frequency of a periodic change (that will be described later in FIGS. 2A, 2B, and 2C) of the delay time of the processing timing of the ECU 20 with respect to the transmission timing of the airflow sensor 14.

For example, the filtering frequency calculation unit 23 calculates a filtering frequency F0 using the following equation (1).

$$F0=\mathrm{abs}(F1-F2) \tag{1}$$

In the above equation (1), F1 indicates the pulsation frequency of the intake pulsation. Further, F2 indicates the delay time frequency (that will be described later in FIGS. 3A and 3B). For example, F1 is calculated using the following equation (2).

$$F1=NE/60\times 2 \tag{2}$$

However, in the above equation (2), NE indicates an engine speed.

Next, the filtering processing unit 24 will be described. The filtering processing unit 24 removes the component of the filtering frequency calculated by the filtering frequency calculation unit 23 from the measurement data of the intake air amount stored in the storage unit 22 (filtering processing step). For example, the filtering processing unit 24 can remove the component of the filtering frequency from the measurement data of the intake air amount using a band removal filter.

Next, the averaging processing unit 25 will be described. The averaging processing unit 25 averages the measurement data of the intake air amounts stored in the storage unit 22 (averaging processing step). With this configuration, for example, the averaging processing unit 25 can suppress the influence of noise included in the measurement data of the intake air amount acquired from the airflow sensor 14. Here, the averaging processing unit 25 averages the measurement data of the intake air amounts after the filtering processing is executed by the filtering processing unit 24, whereby occurrence of an undulation phenomenon in the measurement data processed by the averaging processing unit 25 can be suppressed.

The ECU 20 may further include, for example, an output unit that externally outputs the measurement data processed by the averaging processing unit 25 and a control unit that executes predetermined control (for example, control of the fuel injection amount) based on the measurement data processed by the averaging processing unit 25.

Further, the ECU 20 is configured to include a central processing unit (CPU), a read-only memory (ROM), a random access memory (RAM), and the like. Each function of the ECU 20 described above is realized, for example, as the CPU executes a program stored in the ROM in the ECU 20.

Next, an example of a periodic change in the delay time will be described.

Figures 2A, 2B, 2C:
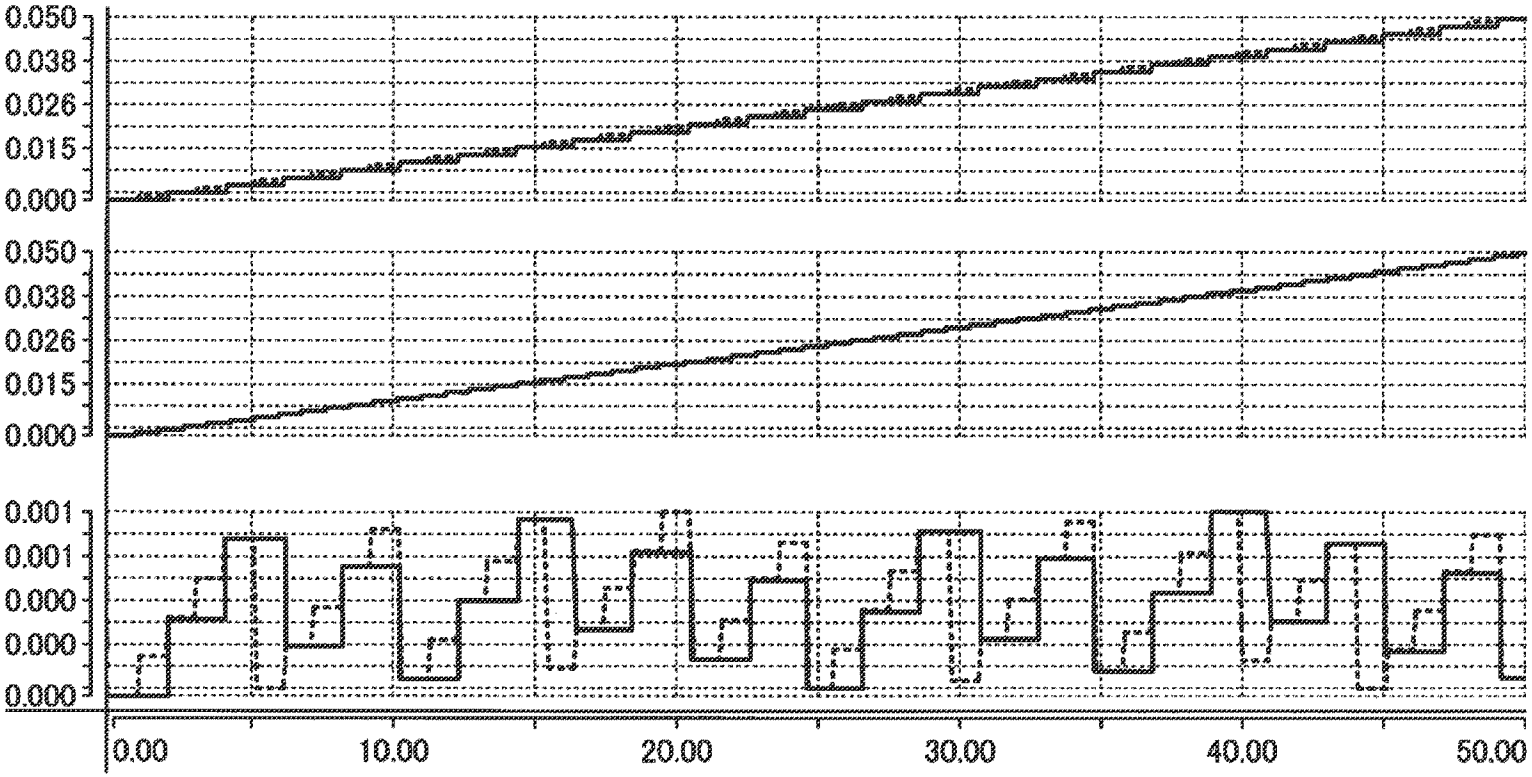
FIG. 2A is a diagram showing an example of a periodic change in delay time that occurs in the data processing system.
FIG. 2B is a diagram showing an example of the periodic change in the delay time that occurs in the data processing system.
FIG. 2C is a diagram showing an example of the periodic change in the delay time that occurs in the data processing system.

FIGS. 2A, 2B, and 2C are diagrams each showing an example of the periodic change in the delay time that occurs in the data processing system 10 according to the embodiment. As shown in FIGS. 2A, 2B, and 2C, the processing timing cycle of the measurement data in the ECU 20 is longer than the transmission timing cycle of the measurement data by the airflow sensor 14. For example, in the example shown in FIG. 2A, the processing timing cycle of the measurement data in the ECU 20 is "1.024 ms" or "2.048 ms". Further, in the example shown in FIG. 2B, the transmission timing cycle of the measurement data by the airflow sensor 14 is "0.846 ms". Therefore, as shown in FIG. 2C, the delay time of the processing timing of the ECU 20 with respect to the transmission timing of the airflow sensor 14 changes periodically. In FIGS. 2A and 2C, the dotted line indicates the case where the processing timing cycle of the measurement data in the ECU 20 is "1.024 ms", and the solid line indicates the case where the processing timing cycle of the measurement data in the ECU 20 is "2.048 ms".

Next, an example of the delay time frequency will be described.

Figure 3B:
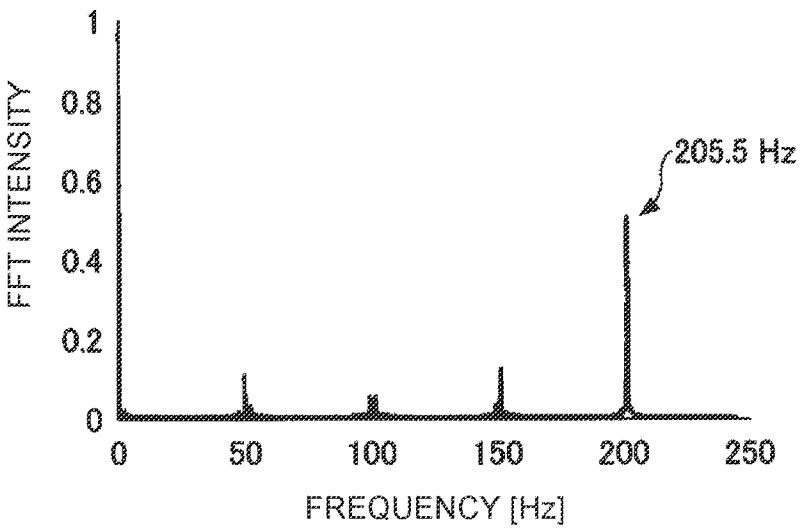
FIG. 3B is a diagram showing an example of the delay time frequency that occurs in the data processing system.
Figure 3A:
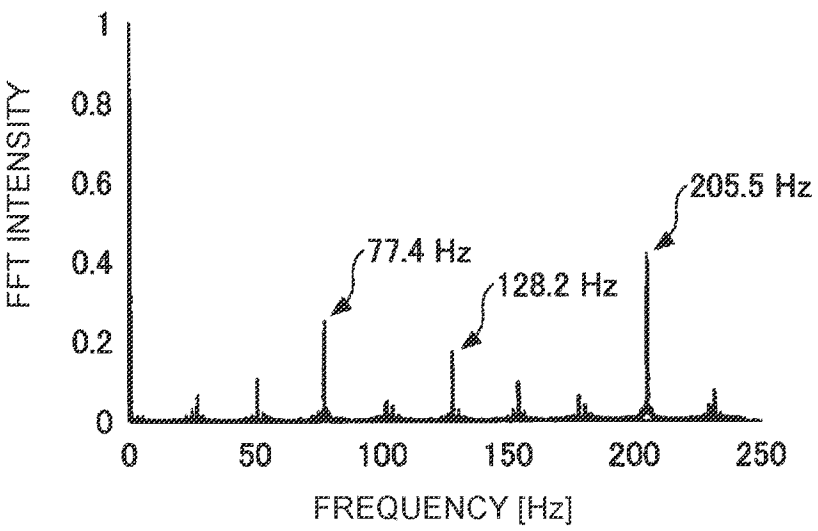
FIG. 3A is a diagram showing an example of a delay time frequency that occurs in the data processing system.

FIGS. 3A and 3B are diagrams each showing an example of the delay time frequency that occurs in the data processing system 10 according to the embodiment.

FIG. 3A shows a result of fast Fourier transform (FFT) analysis of the delay time that occurs when the transmission timing cycle of the measurement data by the airflow sensor 14 is "0.846 ms" and the processing timing cycle of the measurement data in the ECU 20 is "2.048 ms". From the FFT analysis result shown in FIG. 3A, when the processing timing cycle of the ECU 20 is "2.048 ms", "77.4 hertz (Hz)", "128.2 Hz", and "205.5 Hz" are obtained as the peak frequencies (that is, the delay time frequencies).

FIG. 3B shows the FFT analysis result of the delay time that occurs when the transmission timing cycle of the measurement data by the airflow sensor 14 is "0.846 ms" and the processing timing cycle of the measurement data in the ECU 20 is "1.024 ms". From the FFT analysis result shown in FIG. 3B, when the processing timing cycle of the ECU 20 is "1.024 ms", "205.5 Hz" is obtained as the peak frequency (that is, the delay time frequency).

Figure 4A:
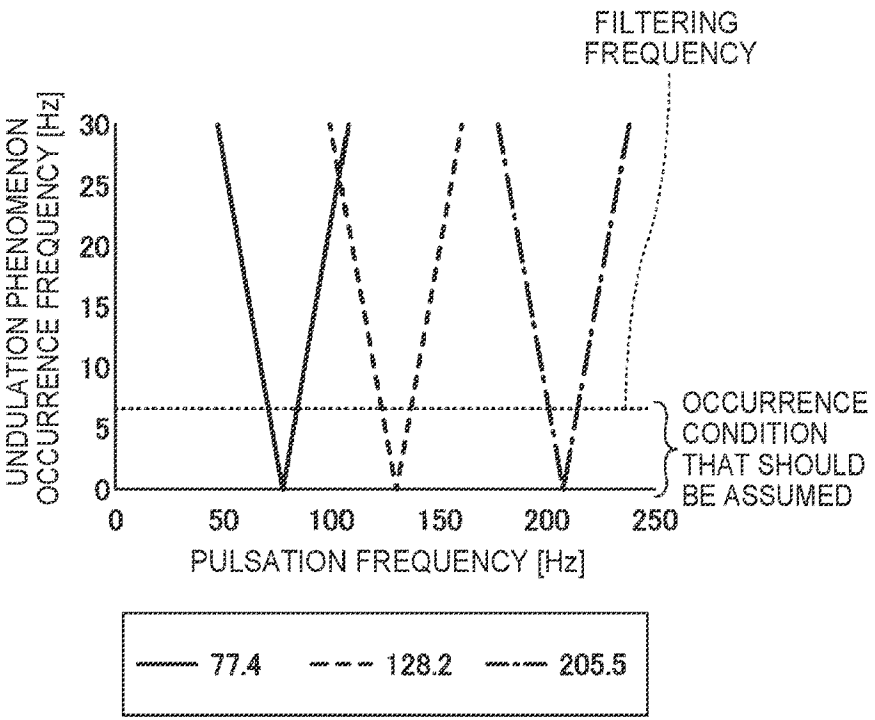
FIG. 4A is a diagram showing an example of an occurrence condition of an undulation phenomenon in the data processing system.
Figure 4B:
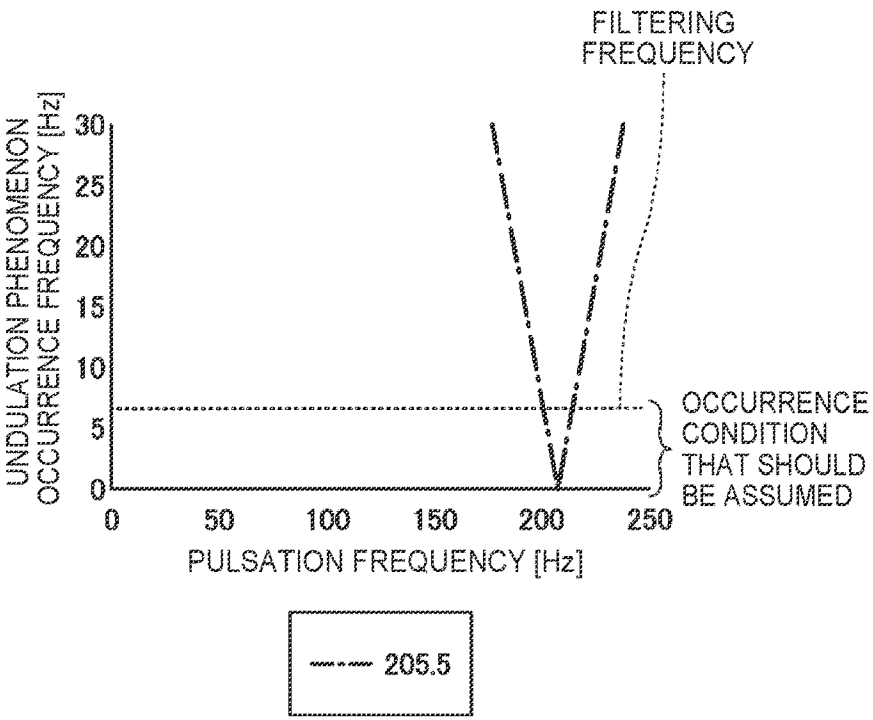
FIG. 4B is a diagram showing an example of the occurrence condition of the undulation phenomenon in the data processing system.
Figures 5A, 5B, 5C, 5D, 5E:
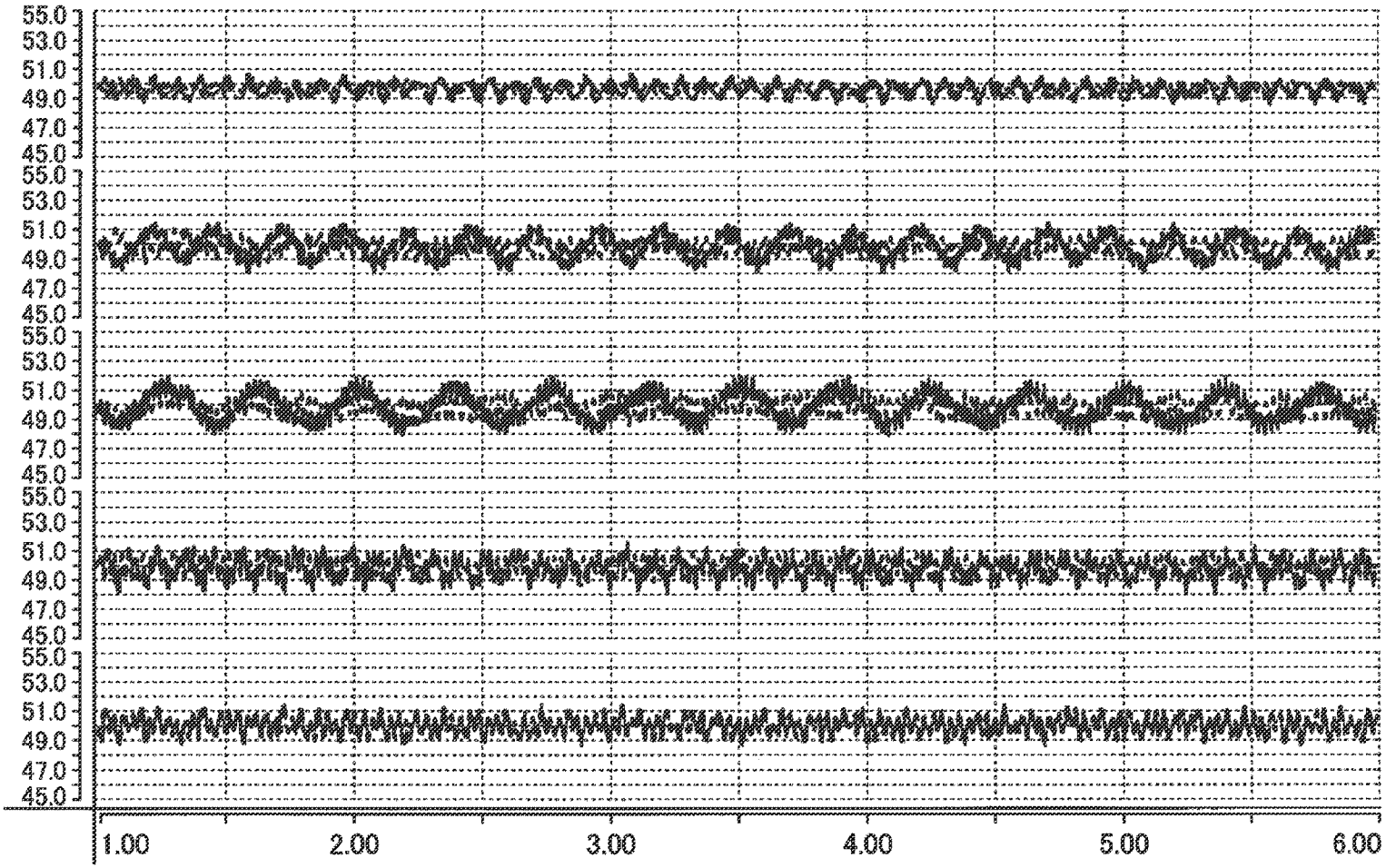
FIG. 5A is a diagram showing an example of an effect of filtering processing in the data processing system.
FIG. 5B is a diagram showing an example of the effect of the filtering processing in the data processing system.
FIG. 5C is a diagram showing an example of the effect of the filtering processing in the data processing system.
FIG. 5D is a diagram showing an example of the effect of the filtering processing in the data processing system.
FIG. 5E is a diagram showing an example of the effect of the filtering processing in the data processing system.

Next, an example of an occurrence condition of the undulation phenomenon will be described. FIGS. 4A and 4B are diagrams each showing an example of an occurrence condition of the undulation phenomenon in the data processing system 10 according to the embodiment. FIGS. 4A and 4B each show, as an example of the occurrence condition of the undulation phenomenon, a relationship between the pulsation frequency [Hz] and an undulation phenomenon occurrence frequency [Hz] for each delay time frequency (see FIGS. 3A and 3B). Note that FIG. 4A shows the occurrence condition of the undulation phenomenon when the processing timing cycle of the measurement data in the ECU 20 is "2.048 ms". Further, FIG. 4B shows the occurrence condition of the undulation phenomenon when the processing timing cycle of the measurement data in the ECU 20 is "1.024 ms". As shown in FIGS. 4A and 4B, the filtering frequency needs to be appropriately set in accordance with the occurrence condition (occurrence frequency) of the undulation phenomenon that should be assumed.

Next, an example of the effect of the filtering processing will be described.

FIGS. 5A to 5E are diagrams each showing an example of the effect of the filtering processing in the data processing system 10 according to the embodiment. In FIGS. 5A to 5E, the dotted line represents the measurement data of the intake air amount before the filtering processing is applied. Further, in FIGS. 5A to 5E, the solid line represents the measurement data of the intake air amount after the filtering processing is applied.

As shown in FIGS. 5A to 5E, the data processing system 10 according to the embodiment can suppress the undulation phenomenon at each of the engine speeds (2000 to 2800 rpm) by causing the filtering processing unit 24 to execute the filtering processing.

Next, a modification will be described.

Figure 6A:
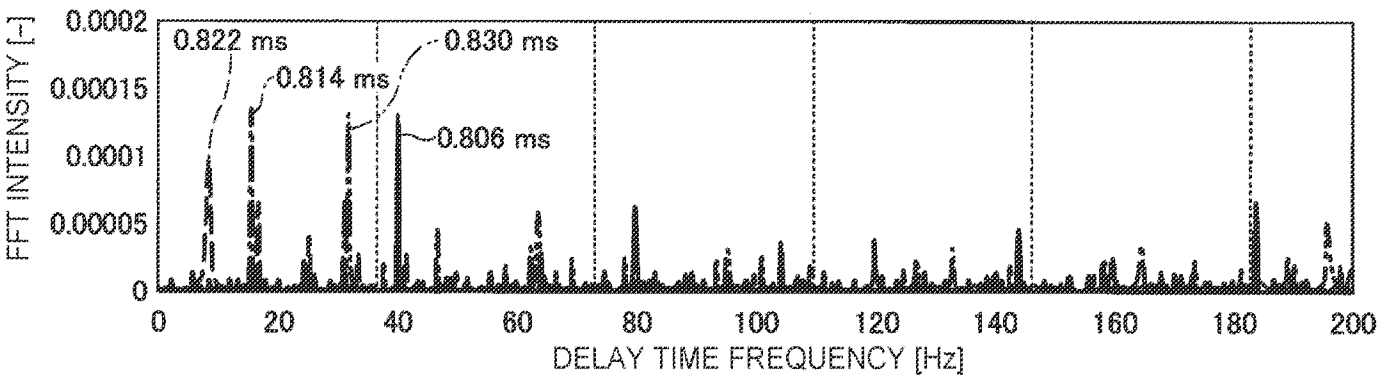
FIG. 6A is a diagram showing an example of a change in the delay time frequency that is caused by an individual difference of an airflow sensor in the data processing system.
Figure 6B:
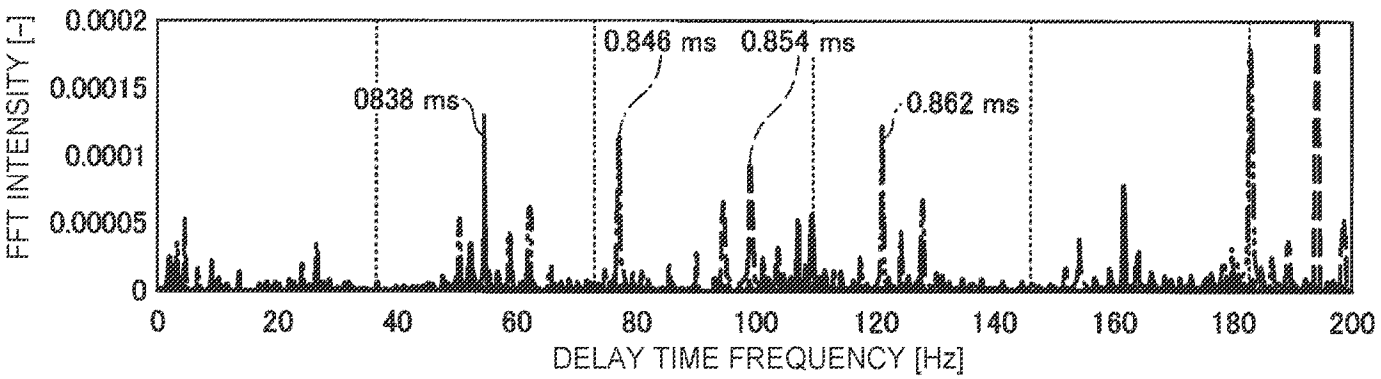
FIG. 6B is a diagram showing an example of the change in the delay time frequency that is caused by the individual difference of the airflow sensor in the data processing system.
Figure 6C:
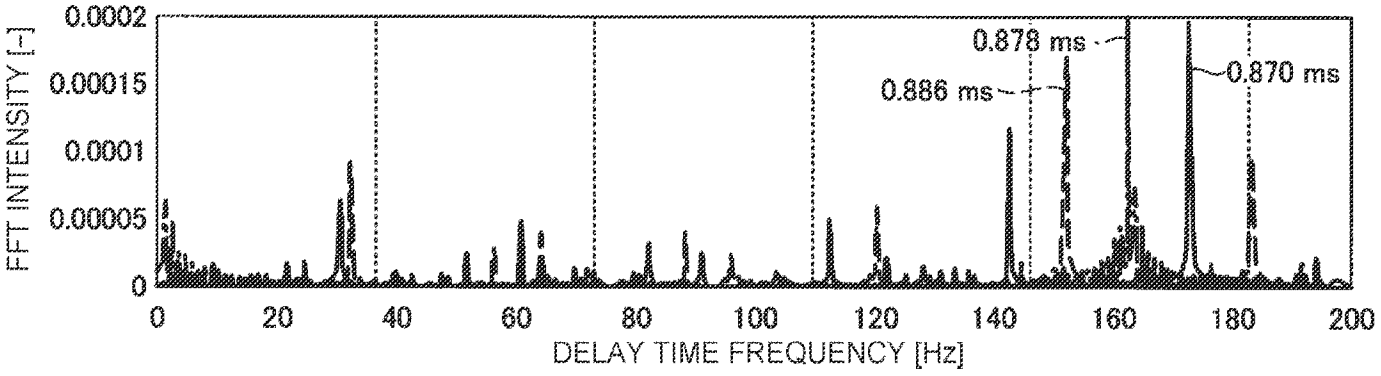
FIG. 6C is a diagram showing an example of the change in the delay time frequency that is caused by the individual difference of the airflow sensor in the data processing system.

FIGS. 6A, 6B, and 6C are diagrams each showing an example of the change in the delay time frequency that is caused by an individual difference of the airflow sensor 14 in the data processing system 10 according to the embodiment. FIGS. 6A, 6B, and 6C each show the FFT analysis result of the delay time for each of the three airflow sensors 14 used as a sample.

Each of the three airflow sensors 14 has a variation in the transmission timing cycle of the measurement data. Therefore, as shown in FIGS. 6A, 6B, and 6C, each of the three airflow sensors 14 has a variation in the delay time frequency based on the transmission timing cycle of the measurement data.

For example, as shown in FIG. 6A, with a first airflow sensor 14, the transmission timing cycle of the measurement data varies as "0.822 ms", "0.814 ms", "0.830 ms", and "0.806 ms". Therefore, in the FFT analysis result shown in FIG. 6A, four peak frequencies (that is, delay time frequencies) are generated.

Further, for example, as shown in FIG. 6B, with a second airflow sensor 14, the transmission timing cycle of the measurement data varies as "0.838 ms", "0.846 ms", "0.854 ms", and "0.862 ms". Therefore, in the FFT analysis result shown in FIG. 6B, four peak frequencies (that is, delay time frequencies) are generated.

For example, as shown in FIG. 6C, with a third airflow sensor 14, the transmission timing cycle of the measurement data varies as "0.886 ms", "0.878 ms", and "0.870 ms". Therefore, in the FFT analysis result shown in FIG. 6C, three peak frequencies (that is, delay time frequencies) are generated.

As described above, when the transmission timing cycle of the airflow sensor 14 varies, the frequency characteristic of the delay time changes. Similarly, when the processing timing cycle of the measurement data in the ECU 20 varies, the frequency characteristic of the delay time changes.

Therefore, the ECU 20 according to the embodiment may execute the filtering processing to remove the component of the filtering frequency by calculating the filtering frequency based on the variation in the transmission timing cycle of the airflow sensor 14 and the variation in the processing timing cycle of the ECU 20 that are measured at an any given timing (for example, an inspection process at the time of delivery from a factory or while a vehicle is traveling). With this configuration, the ECU 20 according to the embodiment can narrow the bandwidth of the filtering frequency, and thus can improve the accuracy of the filtering processing.

Although the data processing method according to the embodiment as an example of the present disclosure has been described in detail above, the present disclosure is not limited to the embodiment, and various modifications and alternations are possible within the scope of the gist of the present disclosure described in the claims.

For example, the filtering frequency may be a filtering frequency obtained in advance by measurement, simulation, or the like for each engine speed, for example, instead of the above equation (1).

Note that, in the embodiment, the measurement data of the intake air amount is used as an example of the "variable measurement data". However, the present disclosure is not limited to this. The "variable measurement data" may be any measurement data as long as the measurement data is data indicating an operating state of the vehicle or data indicating an operating state of the internal combustion engine that are accompanied by periodic fluctuations. Therefore, the "variable measurement data" is not limited to that measured by the airflow sensor, and may be any data measured by any other sensors.

What is claimed is:

1. A data processing method of variable measurement data in an electronic control unit of a vehicle, the data processing method comprising:

acquiring measurement data from a sensor of the vehicle;

performing a calculation of a filtering frequency based on a pulsation frequency of the measurement data minus a delay time frequency, the delay time frequency based on a transmission timing cycle of the measurement data between the sensor and the electronic control unit and a processing timing cycle of the measurement data in the electronic control unit; and removing a component of the filtering frequency from the measurement data.

2. The data processing method according to claim 1, wherein the measurement data is data indicating an operating state of the vehicle.

3. The data processing method according to claim 1, wherein the measurement data is data indicating an operating state of an internal combustion engine of the vehicle.

4. The data processing method according to claim 3, wherein the measurement data is data indicating an intake air amount of the internal combustion engine.

5. The data processing method according to claim 1, wherein the delay time frequency is a peak frequency determined by a fast Fourier transform of the transmission timing cycle and the processing timing cycle.

* * * * *